United States Patent [19]

Simeth

[11] Patent Number: 4,538,514

[45] Date of Patent: Sep. 3, 1985

[54] INKING OR DAMPING UNIT FOR ROTARY PRINTING MACHINES

[75] Inventor: Claus Simeth, Offenbach am Main, Fed. Rep. of Germany

[73] Assignee: M.A.N.-Roland Druckmaschinen Aktiengesellschaft, Offenbach am Main, Fed. Rep. of Germany

[21] Appl. No.: 627,848

[22] Filed: Jul. 5, 1984

[30] Foreign Application Priority Data

Jul. 7, 1983 [DE] Fed. Rep. of Germany ..... 3324447

[51] Int. Cl.[3] ..... B41F 7/26; B41F 31/38

[52] U.S. Cl. ..... 101/148; 101/351; 101/DIG. 6; 29/124

[58] Field of Search ..... 101/DIG. 6, 350, 363, 101/148, 348, 349, 351, 352, 205, 206, 207, 208, 209, 353, 356, 358; 29/116 AD, 124, 130

[56] References Cited

U.S. PATENT DOCUMENTS

| | | | |
|---|---|---|---|
| 1,088,717 | 3/1914 | Neidich | 101/351 |
| 2,676,563 | 4/1954 | Montgomery et al. | 101/350 X |
| 3,456,582 | 7/1969 | McClenathan | 29/116 AD X |
| 4,362,102 | 12/1982 | Despot | 101/348 |
| 4,376,330 | 3/1983 | Weidinger | 29/116 AD |
| 4,455,938 | 6/1984 | Loudon | 101/148 |
| 4,467,720 | 8/1984 | Gertsch | 101/DIG. 6 |

FOREIGN PATENT DOCUMENTS

| | | | |
|---|---|---|---|
| 135665 | 10/1980 | Japan | 101/348 |

*Primary Examiner*—Edgar S. Burr
*Assistant Examiner*—Charles A. Pearson
*Attorney, Agent, or Firm*—Leydig, Voit & Mayer, Ltd.

[57] ABSTRACT

An inking or damping unit is provided for rotary printing machines in which a metering roller and transfer roller are in contra-rotating contact under pressure and a liquid feed with a self-regulating level is disposed above and between the rollers. Zonal liquid transfer is made by way of intermediate zone rollers arranged closely together side by side on a carrier tube and eccentrically movable thereon such that the intermediate rollers accurately transfer the liquid from the transfer roller to a following machine roller.

7 Claims, 3 Drawing Figures

INKING OR DAMPING UNIT FOR ROTARY PRINTING MACHINES

FIELD OF THE INVENTION

This invention relates to an inking or damping unit for rotary printing machines.

BACKGROUND OF THE INVENTION

Known ink metering systems regulate the film of ink by means of a duct blade or an ink spreader using an immersed or film roller. For example, East German Patent Specification No. 104 259 discloses a metering system with nip regulation accomplished by simultaneous variation of the differential speed between the duct roller and the squeegee roller. For reasons of space, the metering discs are suspended only on one side and the transverse spreading movement tends to buckle the mounting plate during operation. Also, the differential speed between the duct roller and the ink-taking roller results in additional forces on the disc mountings.

West German Patent No. 2 210 020 also discloses an inking unit in which the metering and transfer rollers are mounted to be relatively movable, a plurality of bimetallic strip spring assemblies being provided which act on the metering roller side remote from the transfer roller. The object of this system is to obtain a specific spacing between the rollers even in the event of temperature fluctuations, and thus obtain a film of ink of constant thickness on the applicator roller.

The disadvantage of each of these known ink metering systems is that the ink is fed from an ink bath, i.e., they have relatively considerable amounts of dead ink which tends to form a skin unless ink agitating means are used. Another disadvantage is that the ink readily becomes dirty and its water content increases. Cleaning the ink bath results in a relatively high ink loss and if this is to be avoided the printer must keep an accurate check as the run is completed, so that the amount of ink required for any other sheets to be printed is still available in the ink duct.

SUMMARY OF THE INVENTION

The primary aim of the present invention is to provide rapidly controllable liquid metering means for a printing press without an ink or water duct, wherein a film of liquid of uniform thickness and extremely finely controllable in lateral zones is transferable over the entire machine width. This is achieved in a damping or inking unit for a rotary printing press by means of a self-regulating liquid feed disposed above the metering and transfer rollers which contra-rotate in contact under pressure and by zone rollers mounted side by side on a carrier tube and selectively movable between the transfer roller and a roller which, depending upon the purpose, may be a distributing roller.

The use of the zone rollers enables the components used in the inking unit and damping unit to be designed with much wider tolerances, since the overall design requires no great accuracy because of its special geometry. This means a considerable saving of costs. Any inaccuracies in the ink duct roller, e.g. running out-of-true, do not have such a marked effect as in prior art inking units with ink spreaders which, by their high pressures, result in deflection of the ink duct roller and hence inaccurate reproducibility in the case of multiple runs.

The zone rollers also offer the possibility of exact and rapid changeover zone-wise from zero transfer to maximum transfer. To this end, the rollers can be set against one another for different times and at different speeds. The downtimes in a four-color sheet-fed offset machine for cleaning the inking unit alone, are about 17% of the total preparatory printing machine time in the case of conventional machines. Some 5% are additionally taken up with introducing the ink and adjusting the prior art ink zones. These downtimes are reduced to a minimum by a much simpler construction of the inking unit.

Other advantages and essential features of the invention will be apparent from the sub-claims and the following description of the exemplified embodiments with reference to the drawing, wherein:

DESCRIPTION OF THE INVENTION

Figure 1:
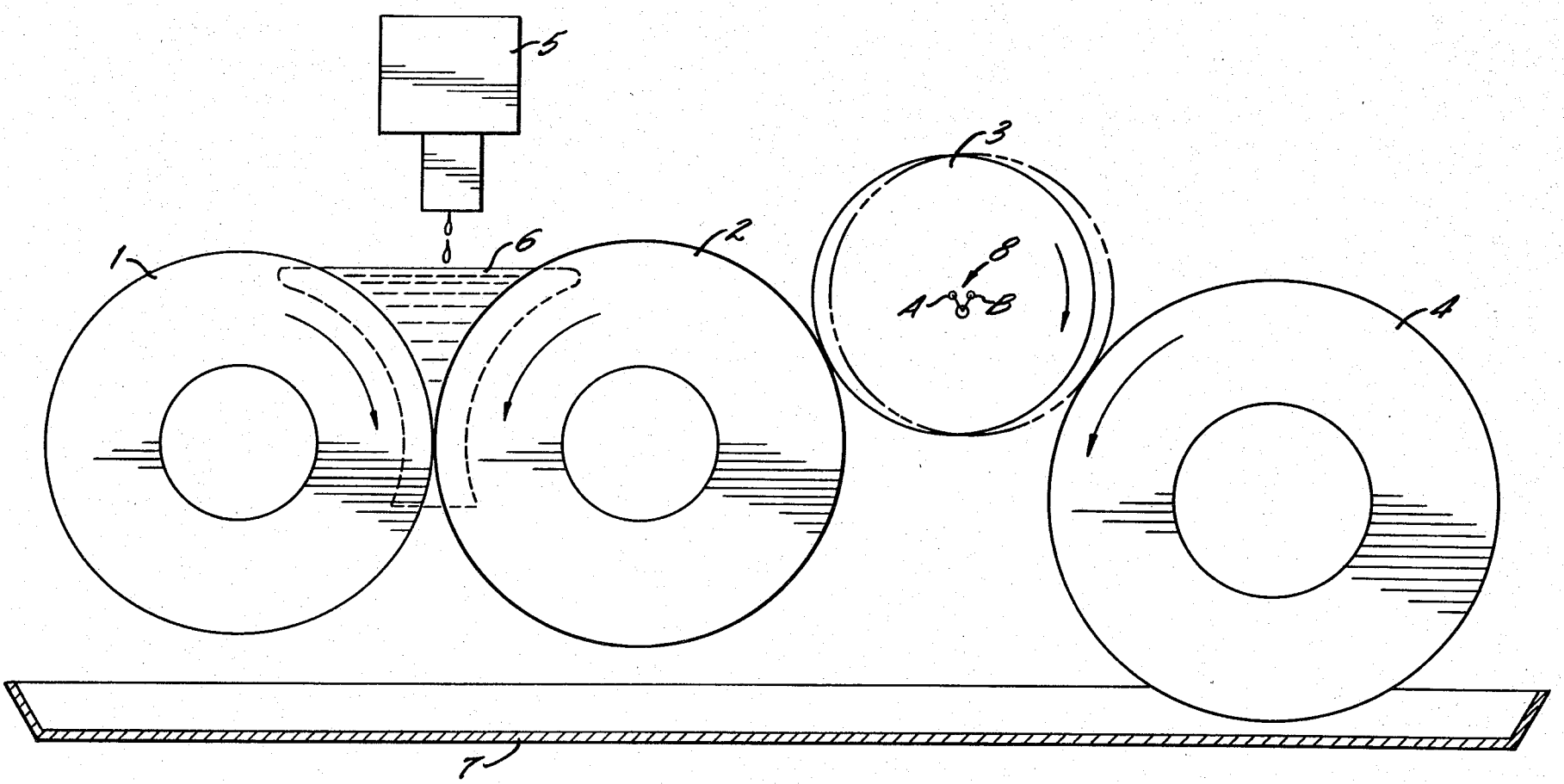
FIG. 1 is a side elevation of an inking or damping unit with a self-regulating liquid feed and the transferring zone rollers.

Turning now to the drawings, there is shown in FIG. 1 a metering roller 1 of a damping or inking unit, for a printing press. The roller 1 is mounted in bearings (not shown) for rotation about a stationary axis. A transfer roller 2 is mounted to be movable into and out of contact with the metering roller 1. In normal operation the transfer roller 2 is applied to the metering roller 1 under pressure so that the pressure in the contact zone between the metering roller 1 and the transfer roller 2 can be extremely finely adjusted. The space above and between the two rollers 1, 2 is filled with a liquid 6 fed by a self-regulating liquid feed 5 in such a manner that the liquid level does not exceed the outer periphery of the two rollers.

Since the rollers 1 and 2 run against one another under pressure, a film of liquid or moisture of equal thickness is transferred to the roller 2 and can be zonally transferred to a roller 4 by means of eccentrically mounted zone rollers 3. Normally roller 4 rotates at a higher speed than the metering roller 1 and transfer roller 2, such that the zone rollers 3 are accelerated on each contact with the roller 4 and decelerated at the transfer roller 2. According to the invention, the mounting of the zone rollers 3 on a carrier tube 8 is of such compact and stable design that the forces during the acceleration and deceleration of the roller 3 are absorbed by the carrier tube 8.

Depending upon the length and nature of the time during which each of the zone rollers 3 is in contact with the transfer roller 2, the zonal ink or moisture transfer by means of the rollers 3 takes place without any gaps between the individual strips of ink or moisture transferred to the roller 4.

The metering roller 1 and transfer roller 2 may be arranged in contra-rotating relation as shown by the arrows in FIG. 1 to; rotate at the same or different speeds and a control for this speed relative to the machine speed can also be incorporated to give an even more differentiated ink film thickness. In the preferred embodiment, the speed of the metering roller 1 and transfer roller 2 is less than the circumferential speed of the roller 4 in dependence on the circumferential speed of the printing machine plate cylinder. This eliminates the need for any complicated regulation via a servomotor.

The pre-metering as indicated above at the metering roller 1 and transfer roller 2 is effected under pressure or from the contact between a steel and a "Rilsan" plastic roller. A drip plate 7 is provided beneath the rollers 1–4.

One basic advantage of the ink metering system is that there is no need to clean the ink duct and the entire ink feed mechanism can be cleaned by means of the existing roller washing mechanism. Consequently, there is no need for any appreciable downtimes for maintenance and preparation for printing on the machine. The above-mentioned "Rilsan" plastic or rubber roller arrangement followed by a steel roller provides optimum ink temperature control in the inking unit, by way of a temperature-control medium flowing through the metering roller 1 and the transfer roller 2.

Figure 2:
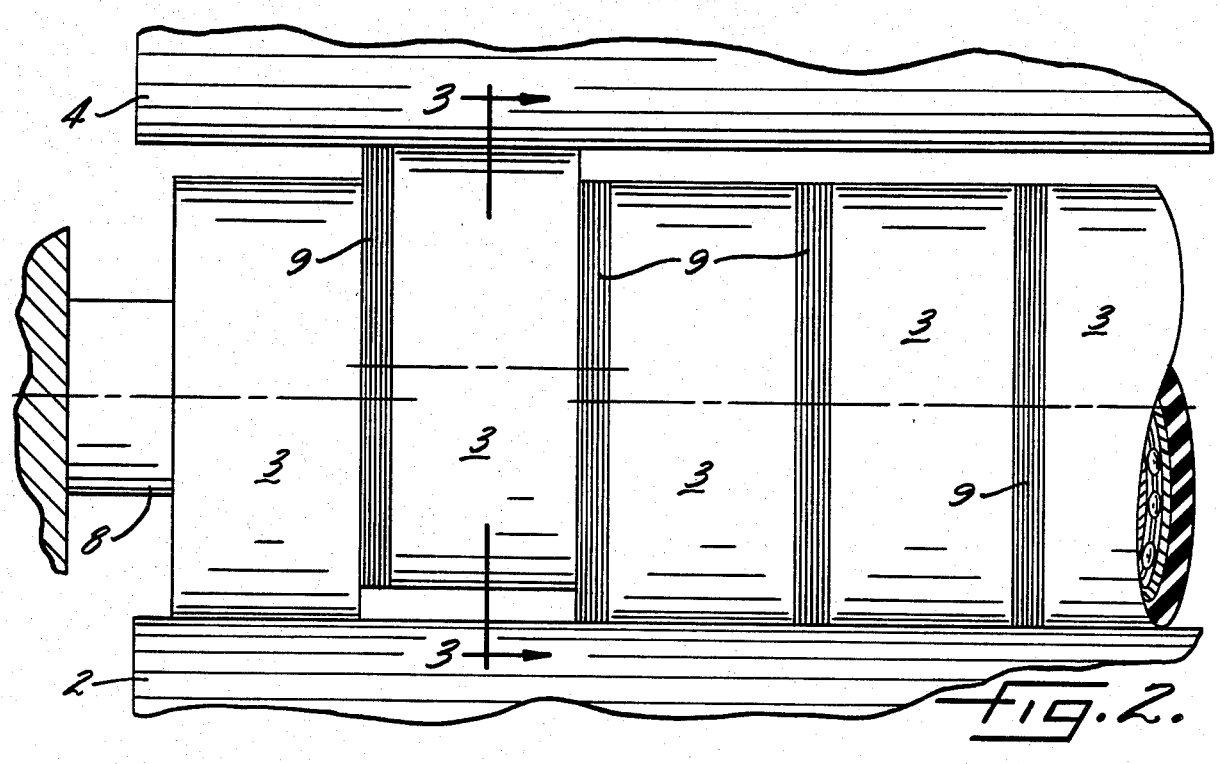
FIG. 2 is a plan view of the zone rollers arranged side by side closely together.

As shown in FIG. 2 the zone rollers 3 are disposed side by side and mounted in a stable manner on the carrier tube 8 between the transfer roller 2 and the roller 4. Depending upon the design of the inking or damping unit, roller 4 may be a spreader roller or simply another transfer roller in the roller train to the plate cylinderof the printing press. It is possible to dispense with spreading directly after the zonal ink transfer because the latter is so precise and accurate, and consequently ink spreading directly at the plate cylinder is quite adequate.

The zone rollers 3, which are disposed closely together side by side, have a sealing ring 9 on one side to prevent the ink from penetrating into the cavities between the rollers. The preferred position of operation of rollers 3 between the transfer roller 2 and the roller 4 is with rollers 3 in contact with the roller 4. This provides ink transfer in the zero flow range because if the rollers 3 are not in contact with the roller 2, no ink is transferred. On the other hand, if the rollers 3 are temporarily brought into contact with the transfer roller 2 covered with a continuous thick film of ink, there is a minimum ink transfer; but, and as the contact time is increased, there is a considerable transfer of ink to the roller 4. Another possibility is for the roller 3 to be continuously brought into contact and disconnected in short pulses. This results in ink transfer with a short strip of ink distributed uniformly over the circumference of the roller 4, and this is equivalent to very uniform ink distribution and application and explains why there is no need for immediate ink spreading after metering as indicated above.

Figure 3:
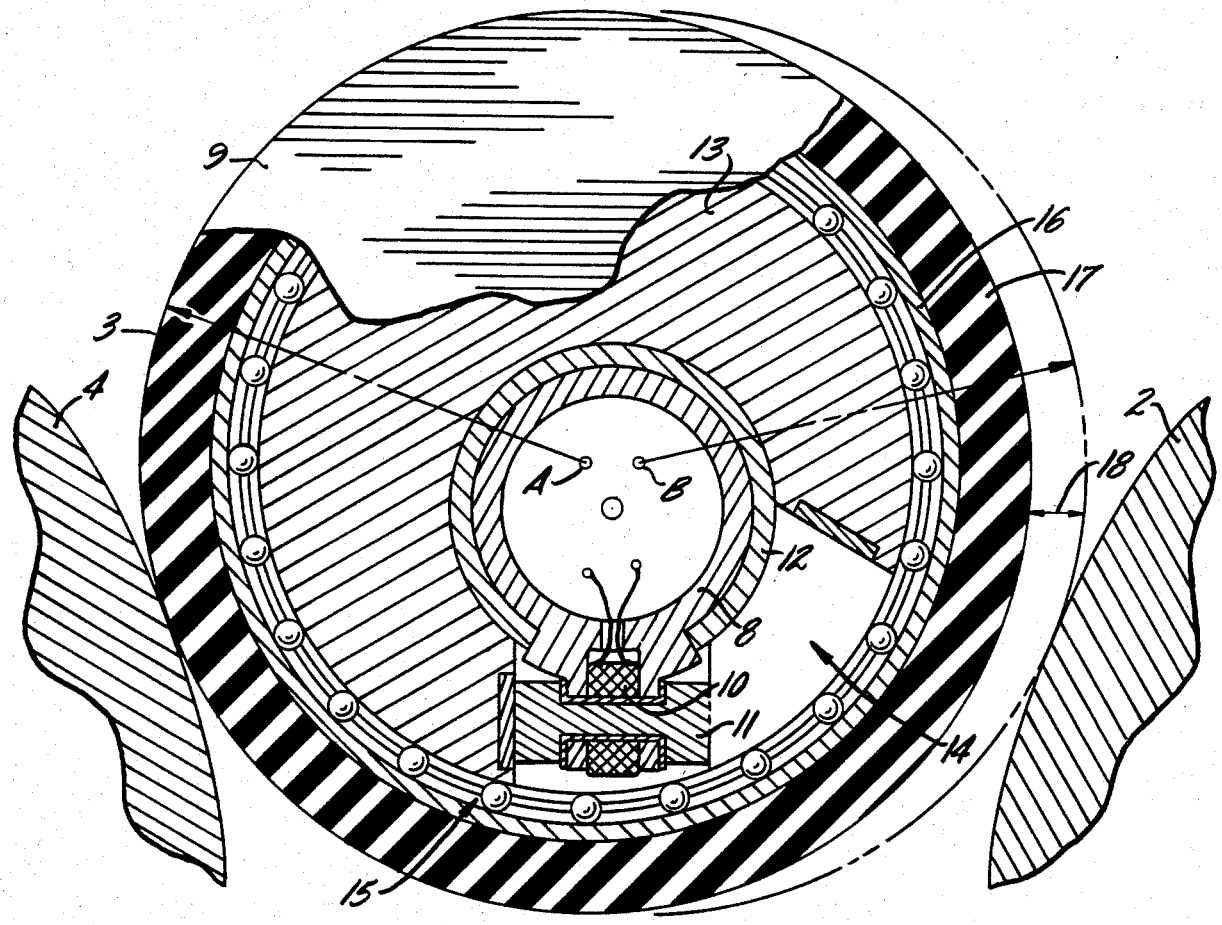
FIG. 3 is a section through the rollers, which are mounted for eccentric movement on a carrier tube.

Referring now to FIG. 3, a preferred construction of the rollers 3 is illustrated, it being understood that the rollers 3 are disposed close together side by side on the carrier tube 8 as mentioned above. As shown here, a coil 10 and magnet core 11 are fastened on the carrier tube 8 with the electrical leads disposed in the central space of the carrier tube. A sliding bearing 12 is disposed around the carrier tube 8 and is recessed in the region of the coil 10 and magnet core 11.

An eccentrically drilled middle part 13 of substantially the same width as a roller 3 is disposed to be freely pivotable on the sliding bearing 12. The middle part 13 has a free space 14 in which the coil 10 and the magnet core 11 are situated. The middle part 13 pivots eccentrically on the carrier tube 8 as a result of the magnetic forces. This eccentric rotary movement corresponds to a shifting movement of the roller 3 as shown at 18 and this eccentric movement is illustrated in the drawing at the middle of the carrier tube 8 in the form of a centerpoint having the two eccentric end points or pivot axes A and B.

A cylindrical roller bearing 15 is provided on the outer periphery of the middle part 13, and a sleeve 16 with a covering 17 which may be shrunk or otherwise secured thereon is rotatably mounted on the roller bearing 15. The covering 17 may be of a plastic or rubber material, depending on the specific purpose of the roller 3 in the inking or damping unit.

It will be understood, of course that the zone rollers 3 can be controlled in different ways, e.g. magnetically, pneumatically or hydraulically. In the case of magnetic control, as shown, there is an eccentric rotary movement of the roller about the carrier tube 8. With pneumatic and hydraulic control there is a rectilinear movement of the roller on the carrier tube. In any event, the roller mounting on the carrier tube is so stable that the reciprocating movement, for example, of the distributing roller, cannot result in tilting due to transverse forces at the rollers 3. Also the different speeds of rotation of the transfer roller and the distributing roller are optimally taken by the stable mounting of the zone rollers on the carrier tube.

The pressure at the point of contact between the metering roller and the transfer roller can be extremely finely adjusted. With this adjustment mechanism it is possible to obtain a uniform liquid film thickness over the entire machine width which is very advantageous for the subsequent uniform transfer of the ink to the following roller train. This means that there is no need to provide a surplus film of ink, something which would entail increased ink spreading and the same construction applied to a damping unit has the advantage that the film of water can be metered to be as uniformly thin as possible in the areas required.

The special construction without an ink duct eliminates the need for time-consuming duct washing. The rollers can be cleaned with the washing mechanism hitherto provided, so that there are no appreciable downtimes for maintenance and print preparation. The defined quantity of ink between the two rollers enables the printer to shut off the liquid supply just before the end of a print run, so that there is practically no longer any ink on the rollers at the end of printing. Cleaning work is thus reduced to a minimum.

Preferably the difference in surface hardness between the metering roller 1 and the transfer roller 2 is about 10 Shore. By pairing "Rilsan", steel, "Rilsan" with rubber and steel surfaced rollers enables an optimum temperature control system to be incorporated with a temperature-control fluid flowing through both rollers. This means that the ink transfer is temperature-independent and has a constantly uniform film thickness.

I claim as my invention:

1. An inking or damping unit for use with rotary printing machines including a metering roller and a transfer roller in contra-rotating contact above the metering roller and the transfer roller so that a film of liquid which is substantially uniform over the entire roller width is produced at the roller nip outlet, said rollers being followed by at least one other machine roller, and a plurality of zone rollers eccentrically mounted side by side on a carrier tube and selectively movable between the transfer roller and said following machine roller for the purpose of zonally metering the film of liquid, characterized in that an electric coil with a magnet core is provided on the carrier tube within the width of each zone roller, bearing means are mounted on the carrier tube, an eccentrically apertured middle part of the zone roller is mounted pivotably on the bearing means, and the middle part has a free space in the region of the magnet core to permit eccentric pivoting of the zone roller.

2. An inking or damping unit according to claim 1, further characterized in that a roller bearing is secured to the outer periphery of the middle part and rotatably supports a cylindrical sleeve with an outer covering thereon.

3. An inking or damping unit according to claim 2, further characterized in that the zone rollers each have a sealing ring on one side 4. An inking or damping unit according to claim 1, further characterized in that a drip plate is provided beneath the metering, transfer and zone rollers.

5. An inking or damping unit according to claim 1 including metallic plates disposed arcuately apart in said free space of the middle part for alternate engagement with the magnetic core upon eccentric pivoting of the zone roller.

6. An inking or damping unit according to claim 1 further characterized in that the carrier tube is provided with a hollow core for receiving the wire leads of the electric coil.

7. An linking or damping unit according to claim 1 further characterized in that said bearing means is in the form of an arcuate bushing on which the middle part is slidably mounted.

* * * * *